US009441362B2

(12) United States Patent
Oppenheimer et al.

(10) Patent No.: US 9,441,362 B2
(45) Date of Patent: Sep. 13, 2016

(54) NOISE REDUCTION IN PRINTERS

(71) Applicant: HEWLETT-PACKARD DEVELOPMENT COMPANY, L.P., Houston, TX (US)

(72) Inventors: Charles Hugh Oppenheimer, Vancouver, WA (US); Michael Allison, Vancouver, WA (US); Kevin Lo, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/422,821

(22) PCT Filed: Sep. 25, 2012

(86) PCT No.: PCT/US2012/057098

§ 371 (c)(1),
(2) Date: Feb. 20, 2015

(87) PCT Pub. No.: WO2014/051548

PCT Pub. Date: Apr. 3, 2014

(65) Prior Publication Data

US 2015/0225943 A1 Aug. 13, 2015

(51) Int. Cl.

| | |
|---|---|
| ***E04B 1/84*** | (2006.01) |
| ***B41J 29/08*** | (2006.01) |
| ***B41J 2/01*** | (2006.01) |
| *B41J 11/00* | (2006.01) |
| *B41J 13/24* | (2006.01) |

(52) U.S. Cl.
CPC .. *E04B 1/84* (2013.01); *B41J 2/01* (2013.01); *B41J 11/0085* (2013.01); *B41J 29/08* (2013.01); *B41J 11/0045* (2013.01); *B41J 13/24* (2013.01)

(58) Field of Classification Search
CPC ..... B41J 29/13; B41J 29/02; B41J 2/1752; B41J 2/17513; B41J 29/38; B41J 11/0045; B41J 13/24; B41J 2/01; B41J 29/08; B41J 11/0085; E04B 1/84
USPC ..... 347/108
See application file for complete search history.

(56) References Cited

U.S. PATENT DOCUMENTS

| | | | | |
|---|---|---|---|---|
| 3,977,492 | A * | 8/1976 | Hankel | E04B 1/86 181/292 |
| 4,636,101 | A | 1/1987 | Matsukura et al. | |
| 4,943,173 | A | 7/1990 | Okazaki et al. | |
| 4,975,966 | A | 12/1990 | Sapiejewski | |
| 2003/0084811 | A1* | 5/2003 | Ishii | B41J 11/0065 101/494 |
| 2008/0073831 | A1* | 3/2008 | Niioka | B65H 5/38 271/228 |
| 2008/0180504 | A1* | 7/2008 | Ishii | G06Q 10/08 347/104 |

(Continued)

FOREIGN PATENT DOCUMENTS

| | | | |
|---|---|---|---|
| JP | 1994-348281 | * 12/1994 | G10K 11/16 |
| JP | 2011167887 | 9/2011 | |

*Primary Examiner* — Manish S Shah
*Assistant Examiner* — Yaovi M Ameh
(74) *Attorney, Agent, or Firm* — Tarolli, Sundheim, Covell & Tummino L.L.P.

(57) ABSTRACT

An apparatus for mitigating noise in a printer can include a plate having a plurality of holes distributed across the plate and extending through the plate, the holes being dimensioned and configured to mitigate acoustic noise in a printer. A mesh material can cover the plurality of holes, wherein the mesh material can increase air flow resistance through the holes and thereby facilitate removal of acoustic noise from a media path in the printer.

10 Claims, 6 Drawing Sheets

(56) References Cited

U.S. PATENT DOCUMENTS

2009/0026691 A1* 1/2009 Ishikawa ..... B65H 5/062
271/10.12
2010/0122869 A1 5/2010 Sengissen et al.
2011/0187769 A1* 8/2011 Hiraide ..... H04N 1/04
347/5

* cited by examiner

NOISE REDUCTION IN PRINTERS

BACKGROUND

Printers are offered in a number of packages and span various types of printing processes. Such printers can include ink-jet printers and laser printers to name but a few. One issue with modern printers is the mechanical complexity required to print on a given media such as paper while moving and processing the given media through the printer during a given print job. Such movements and processing typically requires mechanical moving devices, such as print heads, rollers, motors, fans, and the like, all which can contribute to an overall acoustic noise level that can be generated by the respective printer during the printing process. Depending on the application and/or environment, such generated levels of noise may be unacceptable.

DETAILED DESCRIPTION

This disclosure relates to media path noise reduction for printers. For example, as media is guided through a printing process, a noise reduction apparatus can reduce noise along the media path for the printing process. The apparatus can include a plate having a plurality of holes (e.g., perforations) dimensioned and configured to mitigate noise in the printer by facilitating passage of sound waves through the holes away from the media path. Sound passing through the holes can then be baffled by absorbent material to reduce noise in the printer. The holes can be tuned (e.g., by size and positioning relative to other holes) to further mitigate noise in the printer. The trailing edge of the holes can include a chamfered portion to promote smooth media passage and mitigate the risk of media jams as the media passes over the holes along the media path. In addition, a mesh material can be positioned over the holes to further increase air flow resistance through the holes and thus, increase acoustic energy dissipation. In some examples, the noise reduction apparatus can include a single plate. In other examples, an additional plate can be provided along the media path, such as on an opposite side of the media path to allow media to pass between the respective plates to further reduce noise. The plate can also be shaped to substantially any surface or contour (e.g., it can be curved) in order to conform to the shape of the media path in various printer designs.

Figure 1:
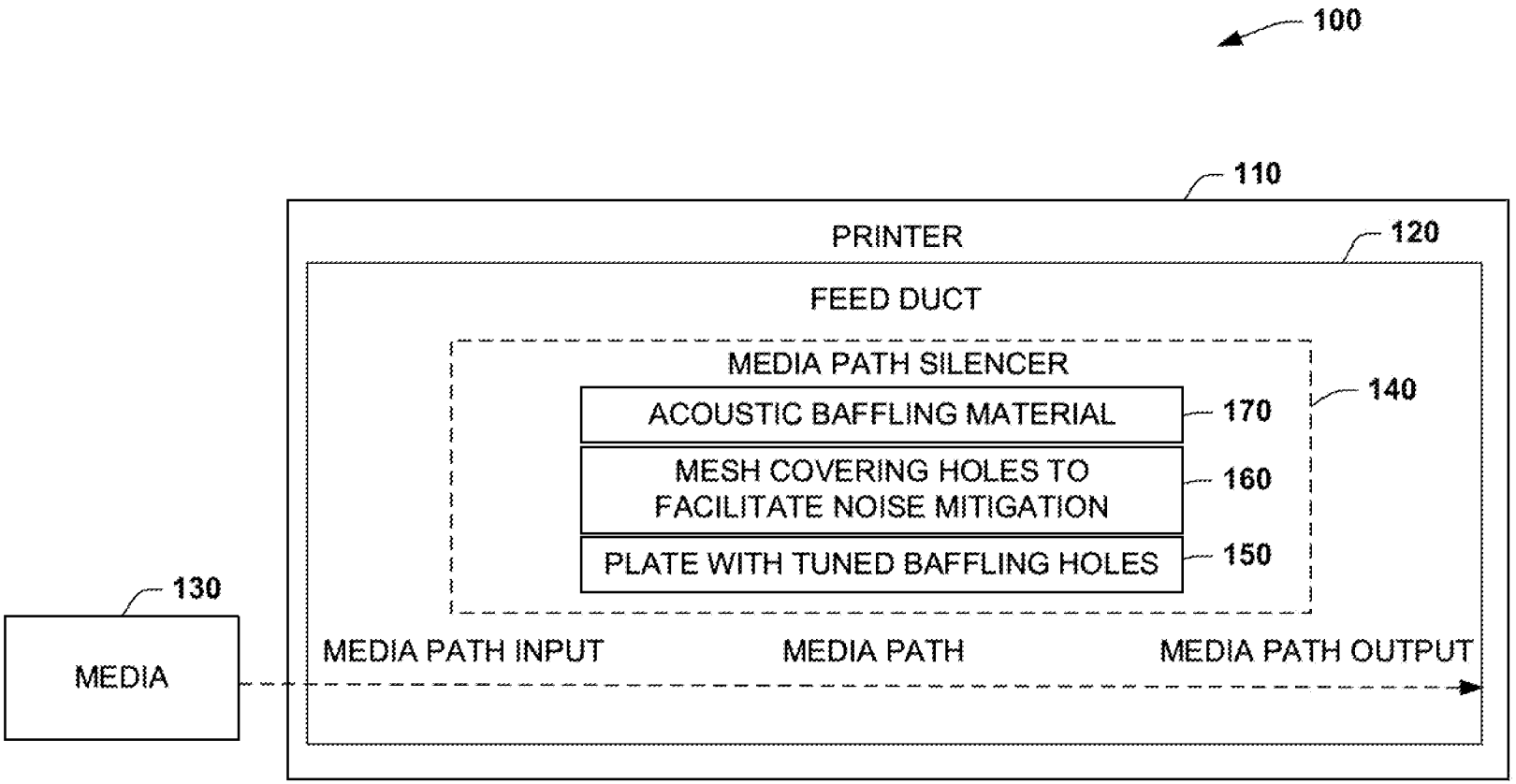
FIG. 1 illustrates an example of a system to facilitate reduction of noise along a media path in a printer.

FIG. 1 illustrates an example of a system 100 to facilitate reduction of noise along a media path in a printer 110. The system 100 includes a printer 110 having a feed duct 120. The feed duct 120 include a media path extending through at least a portion of the feed duct that provides a passage through the printer along which media travels for implementing a printing process. The printer can be configured to perform any type of printing process (e.g., ink, laser or the like). The media path can be substantially linear and/or it may extend curved portions. For example, media 130 (e.g., a sheet of paper, Mylar, vellum or the like) enters the media path a media path input and exits the feed duct at a media path output.

As shown, an apparatus demonstrated as a media path silencer 140 can be positioned in the feed duct 120 along the media path to mitigate noise in the printer 110. The media path silencer 140 can include a plate 150 having a plurality of holes spatially distributed across the plate and extending through the plate. The holes can be dimensioned and configured to mitigate acoustic noise in the printer 110. As disclosed herein, means can be provided along the media engaging surface of the plate for facilitating the passage of media (e.g., mitigate resistance to media) that travels over the holes. Such means can include implementing a chamfered portion along a trailing edge of the holes, providing ribs adjacent the holes to help urge the media away from the media engaging surface and combinations thereof. Some ribs can extend about the entire length of the plate in the direction of media travel. As another example, small guide ribs (e.g., having a length that is commensurate with or less than a diameter of the holes) can precede the holes in the plate 150 to further minimize media jam risk.

A mesh material 160 (e.g., glass cloth, wire mesh) can be positioned to cover the plurality of dimensionally configured holes to increase air flow resistance through the holes. Such increased airflow resistance through the holes can increase dissipation of acoustic energy in the printer 110 as well as increase the attenuation bandwidth of the media path silencer 140.

An acoustic baffling material 170 can also be provided to dampen the noise in the printer 110. The acoustic baffling material can be positioned over a surface of the plate that is opposite from the media engaging surface. Where a mesh is used in addition to the acoustic baffling material, for example, a sheet of the mesh material can be interposed between the acoustic baffling material and the non-media engaging surface of the plate. The acoustic baffling material can be implemented as a sheet of a fibrous material, fiberglass, felt, or other sound baffle materials having desired acoustic properties for reducing acoustic energy. In some examples, the plate 150 can be part of enclosure that provides a cavity, which extends between the plate and a corresponding back panel. The cavity can be filled with the acoustic baffling material 170. As noise passes through the holes in the plate 150, the acoustic energy thus can be absorbed by the baffling material.

The media path silencer 140 can be shaped as a flat structure to be positioned inside a rectangular feed duct 120. Alternatively, the media path silencer 140 can be curved, contoured, or other shape to fit the style of feed duct 120 employed. For instance, if the feed duct 120 curved upward at the media path output of the printer 110, then the media path silencer could also be configured with an upward curve to accommodate such path. In some examples, the media path silencer can be substantially co-extensive with the feed duct 120, including along the direction of media travel, along a direction that is transverse to media travel or both.

The plate 150 can be substantially any type of rigid material (e.g., plastic or metal) capable of supporting holes fixed in space. In some examples the plate can be integrated and incorporated into existing structures within the feed duct within the printer as the plate material. Alternatively, the plate 150 can be attached as a separate structure inside the feed duct 120 such as disclosed herein with respect to FIG. 5.

As noted above, the plate 150 of the media path silencer 140 can include holes. The holes can be acoustically configured and sized to promote sound absorption and may be tuned to problem noise frequencies as described herein. Such holes can be sized and positioned across the plate 150 to mitigate acoustic noise as will be described below with respect to FIG. 2. Acoustic energy passing through the holes via sound waves can then be absorbed by the acoustic baffling material 170 to further reduce noise in the printer. In addition, the mesh material 160 can be positioned over the holes to further increase air flow resistance through the holes and thus, further mitigate noise in the printer. The media path silencer 140 can be a single plate (or other shape) in one example. In another example, the media path silencer 140 can include one or more additional plates along the media path to further reduce noise as shown in the example below with respect to FIG. 5. The plate 150 can also be configured to correspond to substantially any surface or contour according to the shape of the media path in various printer designs. For example, the mediate engaging surface can be planar or it may be curved. The holes can have a chamfered trailing edge such as can be offset from the hole along a direction of media travel to promote smooth media passage and mitigate the risk of media jams as the media passes over the holes along the media path. Such features will be illustrated and described below with respect to FIGS. 2 and 3.

The media path silencer 140 can absorb acoustic noise generated by media sliding, shaft bearing, and gear mesh noise sources along the media path before escaping through the media path output, thereby relaxing design tension between printer speed performance and noise emission, which increases with printer speed. The media path silencer 140 can be located near the media path output along one or both sides of the media path, facing the media and typically spanning the full width of the media path.

By way of further example, the porosity and size of the holes in the plate 150 may be tuned to problem noise frequencies by forming a dynamic absorber involving airflow inertia playing against cavity compliance. For instance, media path sound resonantly pumps oscillating airflow through the perforations in the plate 150 and the adjacent acoustic baffling material 170, thereby maximizing sound absorption inside the printer 110 and thus reducing noise that may escape from the feed duct 120 and into the environment surrounding the printer 110.

By employing tuned holes in the plate 150 and utilizing the mesh material 160 over the holes, the media path silencer 140 can mitigate a broader band of frequencies than conventional noise reduction components (e.g., Helmholtz resonator) that may be designed for one particular frequency band. Such narrow band filters generally do not provide suitable reduction over a broader range of acoustical noise/frequencies that can be generated by modern printing devices. Various configurations for the media path silencer are possible depending on the desired amount of noise to be reduced and other considerations such as cost for example. In one example, the media path silencer includes a plate having a plurality of holes distributed across the plate and extending through the plate to mitigate acoustic noise in the printer 110. In another example, a second plate can be provided (See FIG. 5 below) having a plurality of holes distributed across the second plate and extending through the second plate to mitigate acoustic noise in the printer. The holes in either of the plates can be positioned, sized, and tuned to mitigate a given band of noise frequencies in the printer. Also, the plate 150 can be configured to conform to the dimensions and configuration of an associated feed duct for the printer (e.g., curved to match contour of a given printer).

In another example, the media path silencer 140 can include a plate having a plurality of holes distributed across the plate and extending through the plate. The holes can be dimensioned and configured to mitigate acoustic noise in a printer. An edge of the holes at the media path surface of the plate can be chamfered to provide a smooth surface extending from within a given hole outwardly toward the media engaging surface of the plate to mitigate resistance to media passing through the printer. The chamfered portion can be formed via machining or molding techniques, for example.

In yet another example, the mesh material can cover the plurality of dimensionally configured holes to increase air flow resistance through the holes as disclosed herein. The mesh can be one or more sheets of the mesh attached to the surface of plate that is opposite the media engaging surface thereof. In other examples, the mesh material can be disposed in the holes, such as can be formed integrally with the holes through injection molding process or be inserted into the holes as a separate structure part of fabrication. This example also can include an acoustic baffling material to dampen noise received from the holes, wherein the acoustic baffling material is positioned against the surface of the plate that is opposite media as it passes through the printer.

Figure 2:
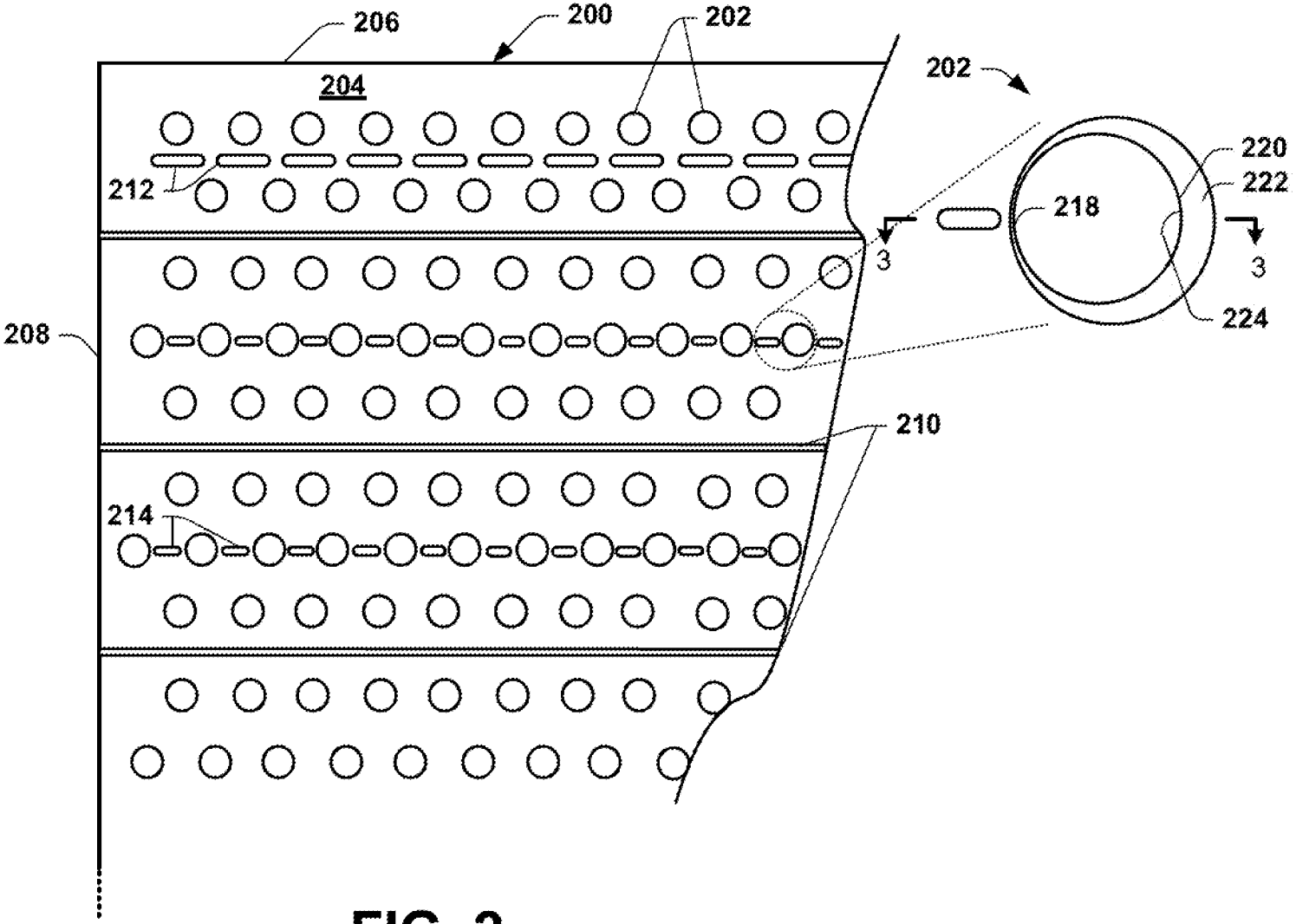
FIG. 2 illustrates example plate and hole patterns for a printer noise reduction apparatus.

FIG. 2 illustrates a partial view of an example plate 200 that can be implemented in a printer noise reduction apparatus. For purpose of scope a partial view of the plate 200 is shown as the size and shape can vary according to application requirements (e.g., the size and shape of a respective feed path). The plate includes a plurality of holes 202 extending through the plate 200 between opposed surfaces thereof the plate. The surface 204 demonstrated in FIG. 1 is a media engaging surface of the plate 200 that is exposed to the media path through which media travels.

Figure 4:
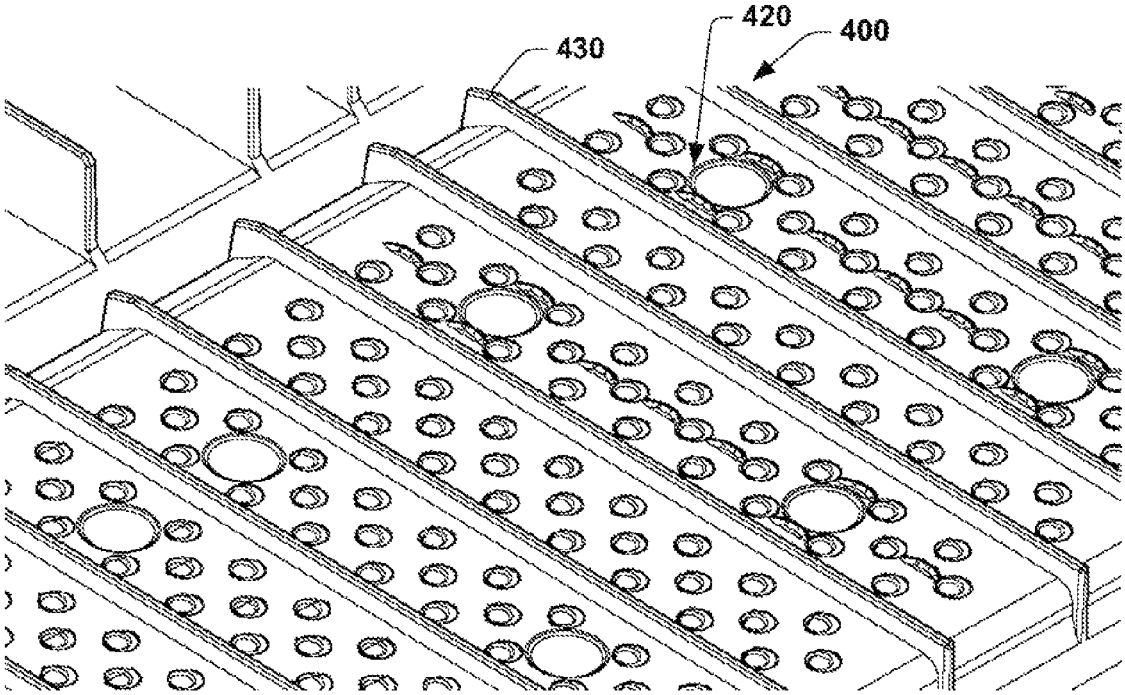
FIG. 4 illustrates example plate and hole placements in the plate for a printer noise reduction apparatus.

The holes 202 are dimensioned and acoustically configured to mitigate noise in a corresponding feed duct. For example, the plate 200 can have M columns of holes extending through the plate which are positioned along N rows, wherein M and N are positive integers denoting the number of holes for a given plate. The spatial distribution of the holes across the plate 200 further facilitates the flow of air and hence acoustic waves from the media path through the holes 202. As disclosed below, FIG. 4 illustrates an example hole placement for a given printer configuration.

In the example of FIG. 2, the surface of the plate 200 extends between spaced apart edges, two intersecting adjacent edges of which are demonstrated at 206 and 208. The rows and columns of holes 202 thus can extend parallel to the respective edges 206 and 208. The plate can also include elongated ribs 210 that extend longitudinally between the edge 208 and its opposed edge (not shown) such as parallel to each other and to the edge 206 that extends along the direction of media travel. The ribs 210 can provide a protruding structure that extends outwardly from the surface 204.

The plate 200 can also include a plurality of smaller guide ribs 212 and 214 that are positioned adjacent at least some of the holes 202. The guide ribs 212 and 214 can extend outwardly from the surface 204 to help guide media outwardly from the surface as it travels in the media path direction. For instance, a leading edge (the edge closest to the edge 208 of the plate) of each guide can extend be sloped or curve outwardly from the surface toward its trailing edge to facilitate the passage of media over the guide rib in the media path direction. The guide ribs 212 and 214 can extend longitudinally in the media path direction but are shorter in length than the ribs 210. For example, the guide ribs 212 and 214 can extend a length that approximates the diameter of the holes 202. In the example of FIG. 2, the ribs 212 extend longitudinally along a virtual line between an adjacent pair of rows of the holes, and have a length that is slightly greater (e.g., about 20-50% larger) than the diameter of the holes. The other guide ribs 214 extend longitudinally between adjacent pairs of ribs of a common row (e.g., intra row guide ribs extending along a virtual line through the holes).

By way of further example, FIG. 2 also demonstrates an enlarged view of a given hole 202. Each of the holes can be similarly configured. As shown in the enlarged view, the hole 202 includes a leading edge 218 and a trailing edge 220. At the media engaging surface of the plate 202, the hole 202 can also include a chamfered portion 222 at its trailing edge to facilitate passage of media passing over the hole in the direction of media travel. For instance, the chamfered portion 222 can extend from a radially inner sidewall 224 of the hole, which is recessed below the surface 204, to terminate in a radially outer edge that defines a juncture between the hole and the surface 204.

Figure 3A:
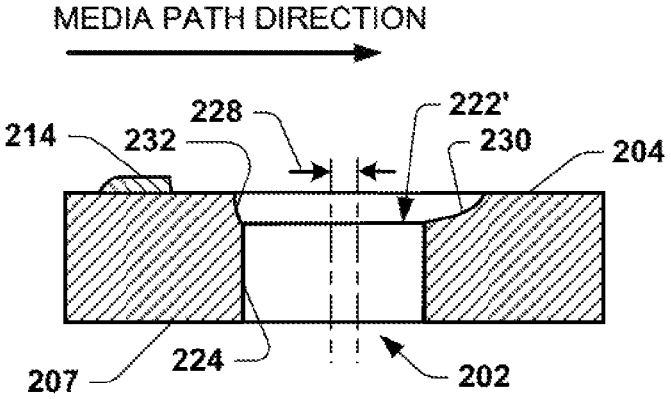
FIGS. 3A and 3B are example of cross-sectional views of a hole taken along line 3-3 of FIG. 2.
Figure 3B:
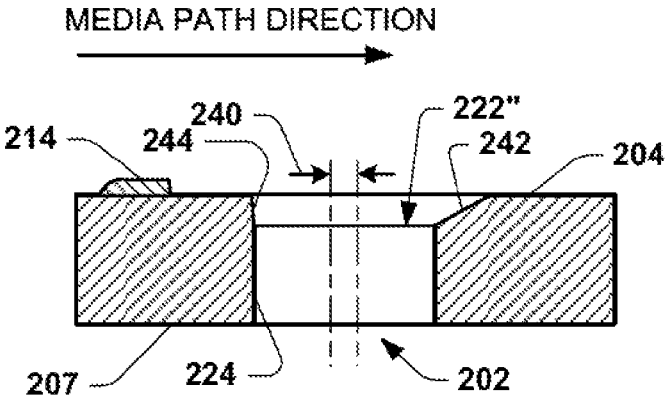

FIGS. 3A and 3B depict cross-section view, taken along line 3-3 from FIG. 2, demonstrating some example configurations for the hole 202. Like reference numbers refer to structural parts previously introduced with respect to FIG. 2. The direction of media as it passes over the hole 256 is shown by an arrow.

In the example of FIG. 3A, the chamfered portion 222' can be offset axially from hole 202 by a distance 228 in the media path direction. The chamfered portion further can extend from a position within the hole that is axially spaced from the surface 204, such as at an axial position between the opposed surfaces 204 and 207 of the plate. The chamfered portion 222' can define a curved surface 230 that extends from the radial inner sidewall 224 of the hole 202 axially toward the surface 204 and radially outwardly to terminate at the exposed surface 207. A leading edge 232 of the chamfered portion 222' can also be offset from the radially inner sidewall 224. The amount of offset at the leading edge 232 can vary, such as ranging from zero offset (i.e., no offset) to a predetermined amount.

In the example of FIG. 3B, the chamfered portion 222" can be axially offset in the media path direction from hole 202 by a distance 240. The chamfered portion 222" further can extend from a position within the hole that is axially spaced from the surface 204, such as at an axial position between the opposed surfaces 204 and 207 of the plate 202. The a chamfered portion 222" can be configured with a flat surface (e.g., a frusto-conical shape) 242 that extends substantially linearly from the radial inner sidewall 224 of the hole 202 axially toward the surface 204 and radially outwardly to terminate at the exposed surface 207. A leading edge 244 of the chamfered portion can also be offset from the radially inner sidewall 224. The amount of offset at the leading edge 244 can vary, such as ranging from zero offset (i.e., no offset) to a predetermined amount.

In each of the examples, of FIGS. 3A and 3B, the chamfered portion can be formed in the hole via machining, such as being counter sunk over the hole 202 to provide a smooth surface resistant to impeding the media. In other examples, the chamfered portion can be formed integrally with the plate, such as through an injection molding process.

Before proceeding with a further description of the media path silencer to mitigate noise in a printer, some of the benefits over conventional devices, such as Helmholtz resonators is described. In contrast to the media path silencer disclosed herein Helmholtz resonators are acoustically compact (small compared to acoustic wavelength) in the direction of the paper path, which forms a sound duct that guides sound to the printer output (paper opening). By contrast, the media path silencer described herein provides silencing of arbitrary length along the media path direction, since noise attenuation can increase with length. The media path silencer disclosed herein attenuates over a broad band of frequencies due to dissipation by acoustic material in the cavity and/or a screen mesh placed alongside the perforated wall of the plate 200. Additionally, the tuning methods described herein may be used for sizing the perforations and cavity, to focus the attenuation of the media path silencer on a broad band of problem frequencies. The broadband attenuation of the media path silencer is well suited not only for printers generating broadband noise but also for multi-mode printers, whose noise spectra may vary with print speed, for example.

The noise reduction of a media path silencer depends on its features at the perimeter of the media path, expressed in terms of normalized mobility y=1/z, where z is normalized impedance:

$$z=(\theta_p+i\chi_p)+r_s/\phi-i/kH \qquad \text{Equation 1}$$

The first parenthetical term describes the perforated panel, the second term describes the screen against the panel, and the third term describes the cavity behind the panel. The resistance and reactance of the perforated panel can be expressed as:

$$\theta_p = 16x^2\left[1+\frac{1}{8x(1+4x^2)}\right]kh_e/\phi \qquad \text{Equation 2}$$

$$\chi_p = \frac{1}{3}\left[4-\frac{10}{x+10}\right]kh_e/\phi \qquad \text{Equation 3}$$

in which $x=d_v/d$ is normalized viscous boundary layer, and $h_e=h+\delta$ is effective thickness of the perforated panel, containing a flow-induced thickness correction $\delta=0.85(1-\phi)d$. The attenuation in dB of the media path silencer can be stated as:

$$\Lambda--8.7\mathrm{Im}(k_x)L \qquad \text{Equation 4}$$

wherein Im( ) is the imaginary part operator. The axial wave number can be given by $$k_x=k\sqrt{1-K_y^2} \qquad \text{Equation 5}$$

The normalized section wave number $K_y$ can be expressed as:

$$K_y\tan(K_ykH) = \frac{i(y_1+y_2)}{1+y_1y_2/H_y^2} \qquad \text{Equation 6}$$

Subscripts 1 and 2 refer to silencer elements on opposite sides of the paper path. For only one silencer element on side 1, $y_2=0$. Solving this relationship generally requires numerical methods, but kH<<1 for paper paths and $$K_y^2 = \frac{i(y_1 + y_2)}{kH} - y_1 y_2 \quad \text{Equation 7}$$

Parameters in the above relationships equations 1-7 can be defined as follows:

c sound speed in air
d perforation hole diameter
$d_v$ viscous boundary layer thickness, $d_v=\sqrt{2\mu/\rho\omega}$
f frequency
h panel thickness
k wave number, $k=2\pi f/c$
H cavity height
$k_x$ wave number along paper path
$K_y$ normalized section wave number transverse to paper path
L silencer length along paper path
$r_s$ mesh airflow resistance
y normalized admittance
z impedance normalized by $\rho c$
$\phi$ perforation porosity, ratio of hole to panel area. $0<\phi<1$
$\mu$ viscosity of air
$\rho$ density of air
$\omega$ radian frequency, $\omega=2\pi f$ FIG. 4 illustrates example plate and hole placements in the plate for a printer noise reduction apparatus. At 400, a top view of an example plate shows examples of holes having offset chamfered portions machined therein to provide a smooth path for media to flow past the holes and mitigate the chances the media could be caught in the holes. The placement of such holes can be selected based on the methods and equations described above with respect to FIG. 2, for example. Large circular structures such as shown at 420 are tooling structures employed to position the panel during assembly and processing. Such tooling structures can also be recessed into the panel to mitigate the potential for media to get caught in the structure. At 430, mechanical ribs can be manufactured into the plate to further reduce the possibility of paper jams in the holes.

Figure 5:
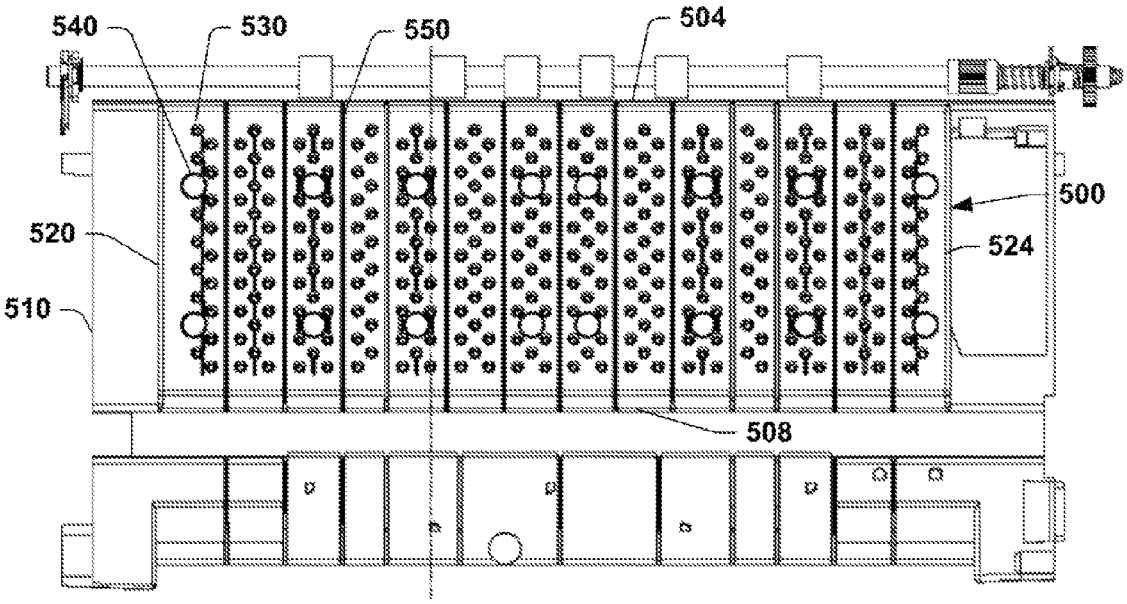
FIG. 5 illustrates an example top view of a plate having perforated holes extending through the plate for mitigating noise in a printer.

FIG. 5 illustrates an example top view of a plate 500 having perforated holes extending through the plate for mitigating noise in a printer. As shown, the plate 500 can include two sides 504 and 508 extending across a portion of the width of a printer feed duct 510. The plate has sides 520 and 524 extending across a portion of the length of the printer feed duct 510. The plate 500 includes chamfered holes such as shown at 530 and can include tooling locations such as shown at 540 for plate processing and manufacturing. Also, the plate 500 can include ribs such as shown 550 to mitigate potential paper jams.

Figure 6:
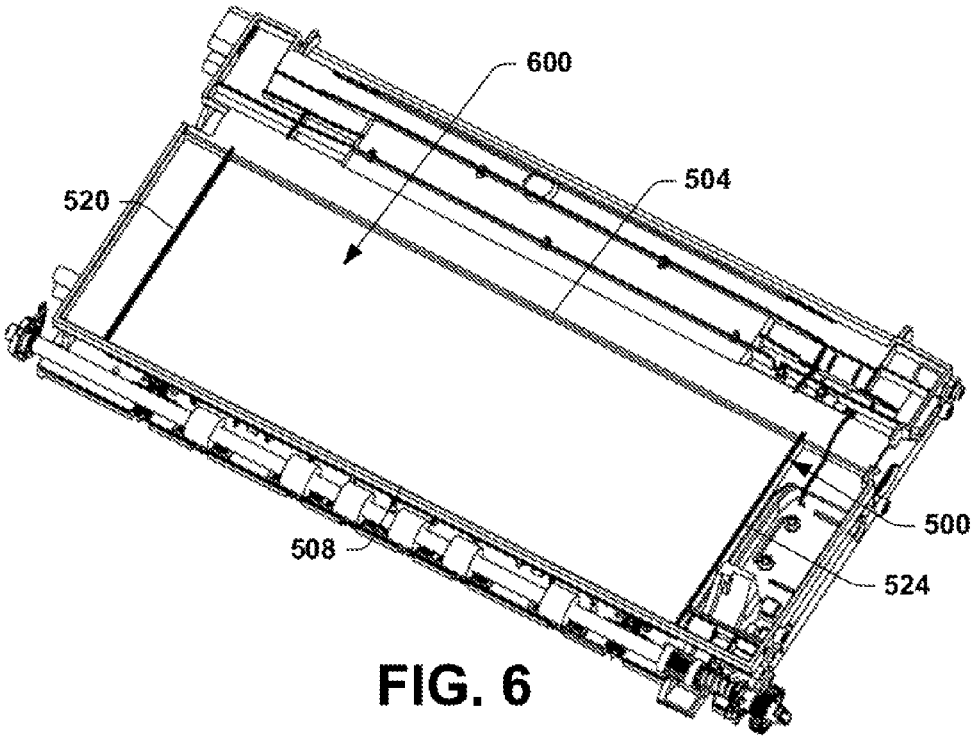
FIG. 6 illustrates a top view of the plate in FIG. 5 having acoustic baffling material installed.

FIG. 6 illustrates a top view of the plate 500 in FIG. 5 having acoustic baffling material installed. The reference numerals to describe FIG. 6 are the same ones used in the discussion of FIG. 5 and correlate to the same locations and structures in both drawings. In this example, a baffling material 600 is placed over the plate 500. The baffling material 600 covers from the sides 504 and 508 and extends to the sides 520 and 524 of the plate. Although not shown, a mesh material can be placed between the baffling material 600 and the plate 500.

Figure 7:
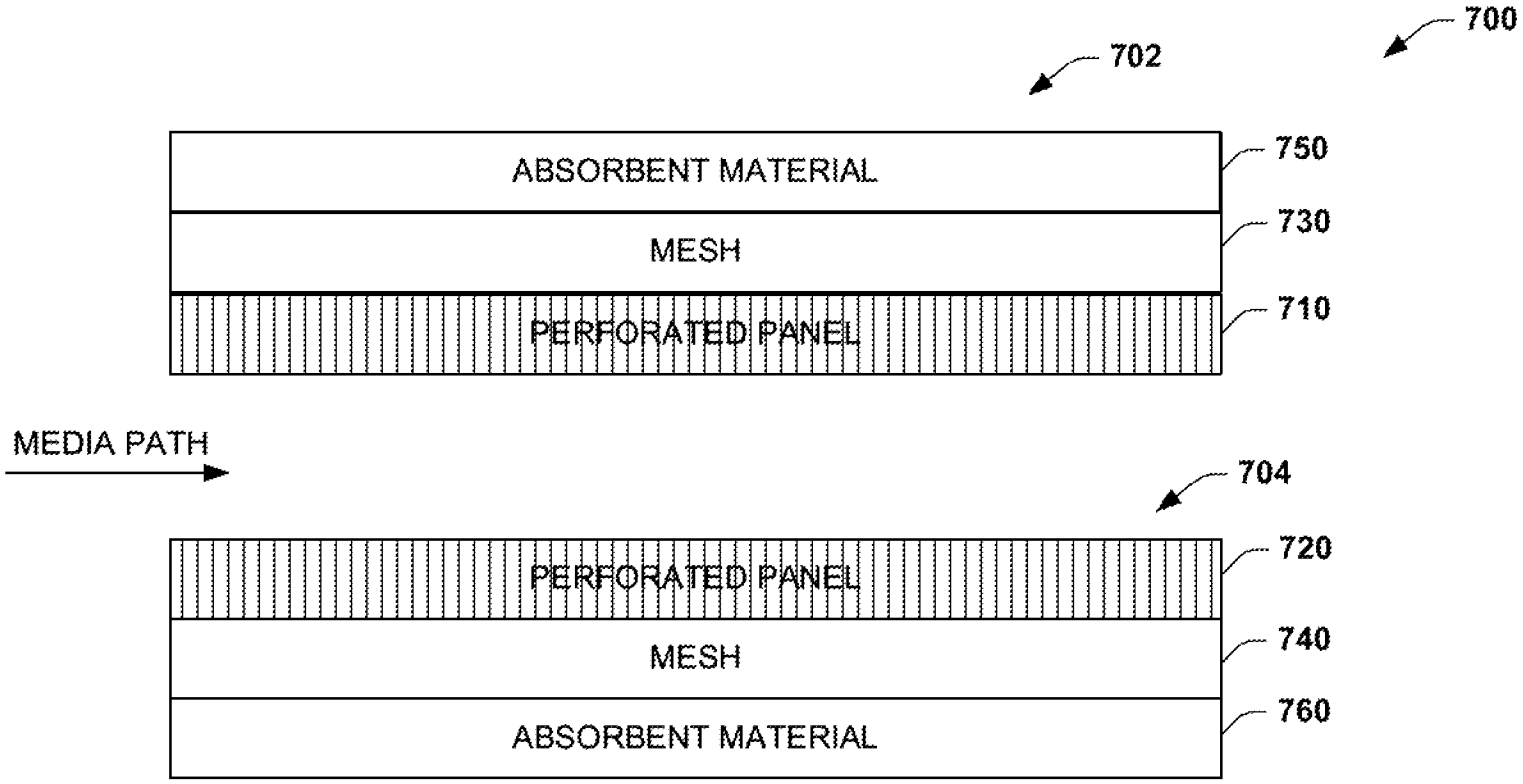
FIG. 7 illustrates an alternative example utilizing multiple silencers for a printer noise reduction apparatus.

FIG. 7 illustrates an alternative example 700 utilizing multiple silencers 702 and 704 for a printer noise reduction apparatus. As shown, a first perforated plate 710 and a second perforated plate 720 can be installed along a media path in a printer. The addition of the second plate can further mitigate noise in the printer. Each plate 710 and 720 can be backed by an absorbent material 750 and 760, respectively, such as fiber glass, for example. Also, each plate can include a mesh material 730 and 740 (e.g., glass cloth, metal screen) between the absorbent material and the plate, wherein the mesh material is employed to increase air flow resistance through the plate.

What have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus comprising:

a plate having a plurality of holes distributed across the plate and extending through the plate, the holes being dimensioned and configured to mitigate acoustic noise in a media path in a printer;

a mesh material disposed within each of the plurality of holes on a side of the plate opposing the media path to increase air flow resistance through the holes; and an acoustic baffling material covering the mesh material to dampen noise received through the holes, wherein:

each of the holes in the plate includes a chamfered trailing edge at a media engaging surface of the plate, along which media engages as it passes through the printer, to facilitate passage of media passing over the holes in the direction of media travel, the chamfers are offset with respect to the holes such that a trailing edge of the chamfers extend in a direction of the media path beyond a radially inner sidewall of the respective hole, and the plate further comprises a rib extending outwardly from the media engaging surface of the plate adjacent at least some of the holes and extending longitudinally in the direction of the media path.

2. The apparatus of claim 1, wherein the acoustic baffling material comprises fiber glass or cloth.

3. The apparatus of claim 1, wherein the mesh material comprises a glass cloth or metal screen that is positioned over the holes along the surface of the plate that is opposite a media passage surface along which media engages as it passes through the printer.

4. The system of claim 1, wherein the chamfer is curved along the direction of the media path from within the hole to the media engaging surface of the plate.

5. The apparatus of claim 1, further comprising another plate having a plurality of holes distributed across the another plate and extending through the another plate to mitigate acoustic noise in the printer.

6. The system of claim 1, wherein the plate is configured to conform to the dimensions of an associated feed duct that extends along the media path for the printer.

7. An apparatus comprising:

a plate having a plurality of holes distributed across the plate and extending through the plate, the plurality of holes being dimensioned and configured to mitigate acoustic noise in a printer, the plate having a rib extending outwardly from a media engaging surface of the plate adjacent at least some of the holes;

a trailing edge of each of the plurality of holes at the media engaging surface of the plate comprising a chamfered portion to mitigate resistance to media passing through a media path of the printer;

a mesh material disposed within each of the plurality of holes on a side of the plate opposing the media path to increase air flow resistance through the holes; and an acoustic baffling material covering the mesh material to dampen noise received through the holes.

8. The apparatus of claim 7, wherein the chamfer portion is offset over each of the plurality of holes to mitigate resistance to the media passing through the printer.

9. System comprising:

a printer comprising a feed duct along a media path; and a noise removal apparatus located within the feed duct along the media path to facilitate removal of acoustic noise, the noise removal apparatus comprising:

a plate having a plurality of holes spatially distributed across and extending through the plate, each of the holes being dimensioned and configured to mitigate acoustic noise in a printer, a trailing edge of each of the plurality of holes at a media engaging surface of the plate comprising a chamfered portion to mitigate resistance to media passing through the printer and over the respective holes, the plate having a rib extending outwardly from the media engaging surface of the plate adjacent at least some of the holes and extending longitudinally in the direction of the media path;

a mesh material disposed within each of the plurality of holes on a side of the plate opposing the media path to increase air flow resistance through the holes and to further reduce the acoustic noise in the printer; and an acoustic baffling material covering the mesh material to dampen noise received from the holes, the acoustic baffling material extending along a surface of the plate that is opposite a media passage surface of the plate along which media engages as it passes through the printer.

10. The system of claim 9, wherein the plate further comprises a rib extending outwardly from the media engaging surface of the plate adjacent at least some of the holes and extending longitudinally in the direction of the media path to mitigate resistance to the media passing by the holes.

* * * * *